United States Patent [19]

Brenner

[11] Patent Number: 5,018,609

[45] Date of Patent: May 28, 1991

[54] SPECIALIZED CASE AND ATTACHMENT FOR CARRYING POSTERS AND OTHER DOCUMENTS IN THE ROLLED UP CONDITION

[76] Inventor: Barry H. Brenner, 5900 Nora Lynn Rd., Woodland Hills, Calif. 91364

[21] Appl. No.: 495,113

[22] Filed: Mar. 19, 1990

[51] Int. Cl.[5] ..... A45C 3/02; A45C 11/26; A45C 11/36

[52] U.S. Cl. ..... 190/108; 190/109; 190/110; 190/111; 206/225; 220/23.4

[58] Field of Search ..... 190/102, 108, 109, 111, 190/112, 110; 150/111; 206/287, 298, 308, 224, 225, 407; 229/93; 224/915, 251; 40/660; 220/23.4, 23.2

[56] References Cited

U.S. PATENT DOCUMENTS

| | | | |
|---|---|---|---|
| 424,603 | 8/1890 | Favor . | |
| 632,167 | 8/1899 | Biesmeyer . | |
| 922,567 | 5/1909 | Cosgrove | 190/102 X |
| 941,745 | 11/1909 | Van Nostrand | 229/93 |
| 1,087,955 | 2/1914 | Knothe | 206/278 |
| 1,491,807 | 4/1924 | McLinn | 190/109 X |
| 1,783,275 | 12/1930 | Berwin | 190/102 X |
| 2,068,765 | 1/1937 | Quinlan | 229/93 X |
| 2,852,132 | 9/1958 | Steinberger et al. | 206/15.1 |
| 3,446,337 | 5/1969 | Blackmon | 206/1.7 |
| 3,842,977 | 10/1974 | Hollander | 206/407 |
| 3,877,572 | 4/1975 | Wiener, Jr. | 206/223 |
| 3,884,351 | 5/1975 | James | 206/225 |
| 4,483,427 | 11/1984 | Gerch | 190/112 X |
| 4,558,807 | 12/1985 | Jackson | 224/915 X |
| 4,574,504 | 3/1986 | Holmer | 40/19 |
| 4,693,346 | 9/1987 | Eversdijk | 190/112 X |
| 4,809,892 | 3/1989 | Chinski | 224/155 |
| 4,852,725 | 8/1989 | Folsom | 206/1.7 |
| 4,911,347 | 3/1990 | Wilhite | 224/251 X |

FOREIGN PATENT DOCUMENTS

| | | | |
|---|---|---|---|
| 742550 | 9/1966 | Canada | 190/109 |
| 2231960 | 1/1973 | Fed. Rep. of Germany | 190/108 |
| 2588455 | 4/1987 | France | 190/108 |
| 12758 | 1/1912 | United Kingdom . | |

*Primary Examiner*—Sue A. Weaver
*Attorney, Agent, or Firm*—Thomas I. Rozsa

[57] ABSTRACT

A carrying case which in particular may be used by a vistor to a trade show where numerous sizes and shapes of objects are distributed for the visitor to take home, some of which are large posters or comparable objects which are preferably carried in the rolled up condition. The case includes various slots for holding discs, business cards, paper and pens, etc. A key point of novelty in the present invention is the use of an attachable cylindrical holder which essentially consists of a cylindrical body formed of semi-rigid material such as thick nylon, and having attaching snaps that enable the cylindrical member to be attached to the case. The purpose of the cylindrical member is so that large posters and other pictures which should not be folded in order to avoid a crease can be rolled up and safely placed in the cylindrical container and thereafter transported to the person's office.

13 Claims, 1 Drawing Sheet

SPECIALIZED CASE AND ATTACHMENT FOR CARRYING POSTERS AND OTHER DOCUMENTS IN THE ROLLED UP CONDITION

BACKGROUND OF THE INVENTION

1. Field of the Invention

The present invention relates to carrying cases which are used to carry documents such as papers, pens, pencils, note pads, and various literature such as advertising flyers and brochures which are obtained by attending meetings, conventions and similar functions. The present invention also relates to the field of cases for carrying large objects such as posters, paintings, blueprints, and similar large documents which are preferably carried in a rolled up condition so as to avoid placing one or more creases in the surface of the document.

2. Description of the Prior Art

In general, there are numerous devices in the prior art which are individually used as cases to carry objects and there are in particular carrying apparatus which are exclusively used to carry documents in a rolled up condition. The following prior art patents are illustrative of the known prior art:

1. U.S. Pat. No. 4,809,892 issued to Chinski et al on Mar. 7, 1989 for "Studio Pack".
2. U.S. Pat. No. 3,446,337 issued to Blackmon on May 27, 1969 for "Artists Supply Cases".
3. U.S. Pat. No. 4,852,725 issued to Folsom on Aug. 1, 1989 for "Carrying And Storage Case For Artist's Supplies".
4. British Patent No. 12,758 issued in 1912 to Pentrup for "Improvements In Field Dispensaries".
5. U.S. Pat. No. 424,603 issued in 1890 to Favor for "Artist's Kit".
6. U.S. Pat. No. 632,167 issued in 1899 to Biesmeyer for "Scholar's Companion".
7. U.S. Pat. No. 2,852,132 issued to Steinberger et al in 1958 for "Paint Brush Container".
8. U.S. Pat. No. 3,877,572 issued to Wiener, Jr. on Apr. 15, 1975 for "Convertible Storage Container/Picture Frame Assembly".
9. U.S. Pat. No. 3,884,351 issued to James on May 20, 1975 for "Drawing Case For Architects And The Like".
10. U.S. Pat. No. 4,574,504 issued to Holmer on Mar. 11, 1986 for "Storage Container".

U.S. Pat. No. 4,574,504 to Holmer discloses a storage container. The storage container is cylindrical and is designed to house drawings and other objects which can be rolled up and stored in a container. The container itself can be attached to a surface by means of brackets. This container is used to exclusively carry rolled up documents and further is not designed to be used in conjunction with a carrying case but is designed to be used only in itself and attached to a wall.

U.S. Pat. No. 3,884,351 to James discloses a conventional architect's drawing case where the drawings can be rolled up around a self-winding spring roller contained within the cylindrical case. This is a free-standing case and it is a cylindrical case incorporated by itself.

U.S. Pat. No. 4,809,892 to Chinski discloses a studio pack including a plurality of compartments. None of the compartments in this studio pack can be used for rolling up a poster but it does disclose the concept of many slots and other holding devices for holding a multiplicity of different objects.

U.S. Pat. No. 4,446,337 to Blackmon also discloses an artist's supply case which contains a multitude of various slots for other devices for holding paints, brushes, etc.

U.S. Pat. No. 4,852,725 to Folsom is another carrying case patent which has a multiplicity of different types of slotted arrangements for retaining different types of objects for use by the artist.

British Patent No. 12,758 to Pentrup discloses a dispensary improvement with various slots and holding features for holding various objects.

U.S. Pat. No. 424,603 to Favor discloses a cylindrical object but it is not used for the purpose of retaining cylindrical items but instead for retaining various objects such as paint brushes and paints but so the entire case can be folded in a cylindrical manner and conveniently carried.

U.S. Pat. No. 632,136 to Biesmeyer discloses a cylindrical object but once again its purpose is to carry pencils and pens and other small things and not a poster.

U.S. Pat. No. 2,852,132 to Steinberger again discloses a cylindrical object but its purpose is to carry paint brushes and the like.

U.S. Pat. No. 3,877,572 to Weiner discloses a convertible storage container which can hold cylindrical objects but can be converted to hold other shapes as well.

While the prior art discloses individual cylindrical carrying cases for carrying rolled up documents, none of the the prior art discloses an adaptable cylindrical carrying case which can be used in conjunction with a more conventional carrying case. There is a significant need for such an apparatus when the user desires to compactly and efficiently carry both flat documents such as brochures, accessories such as pencils, pens, measuring instruments, calculators, etc., and also larger objects such as posters, drawings or blueprints which are preferably carried in a rolled up condition. In addition, there is a significant need for a case which can be taken to trade shows and conventions where numerous literature and physical objects are given away by vendors and companies which have booths at the trade show and which objects include flat documents such as flyers, brochures, catalogues, etc. and larger objects such as posters which are preferably carried in a rolled up condition.

SUMMARY OF THE PRESENT INVENTION

The present invention comprises of a carrying case which in particular may be used by a visitor to a trade show where numerous sizes and shapes of objects are distributed for the visitor to take home, some of which are large posters or comparable objects which are preferably carried in the rolled up condition. The case includes various slots for holding discs, business cards, paper and pens, etc. A key point of novelty in the present invention is the use of an attachable cylindrical holder which essentially consists of a cylindrical body formed of semi-rigid material such as thick nylon, and having attaching snaps that enable the cylindrical member to be attached to the case. The purpose of the cylindrical member is so that large posters and other pictures which should not be folded in order to avoid a crease can be rolled up and safely placed in the cylindrical container and thereafter transported to the person's office. The overall concept of having the cylindrical case containing the posters which can be rolled up and transported in this manner and attached by snaps or comparable attaching means to the case is unique.

It has been discovered, according to the present invention, that if a carrying case is fitted with one type of mating means such as snaps or Velcro-R along at least one edge and a separable cylindrical carrying case is also fitted with comparable mating means such as a mating Velcro-R closure member or mating snaps, then the cylindrical carrying case and the regular carrying case can be joined together to form one compact carrying case in which any desired shape object can be carried.

It has further been discovered that if the mating and attaching means on the cylindrical carrying case are retained on the case by flexible strap members, then the cylindrical carrying case can be very easily and removably attached to the mating members along one side of the main carrying case.

It has also been discovered that if one end of the cylindrical carrying case is openable by means such as a zipper extending around the circumference of the case adjacent one end, then objects such as posters can be rolled up and inserted into the cylindrical case while it is still attached to the main case.

It is therefore an object of the present invention to provide a combination carrying case which can be used to carry objects of any desired shape and configuration, including flat objects such as brochures, pencils, diskettes, tape, measuring instruments, and also larger objects which are preferably carried in a rolled up configuration.

It is a further object of the present invention to provide a carrying case wherein the cylindrical container in which rolled up objects are placed is removably attached to the main case.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
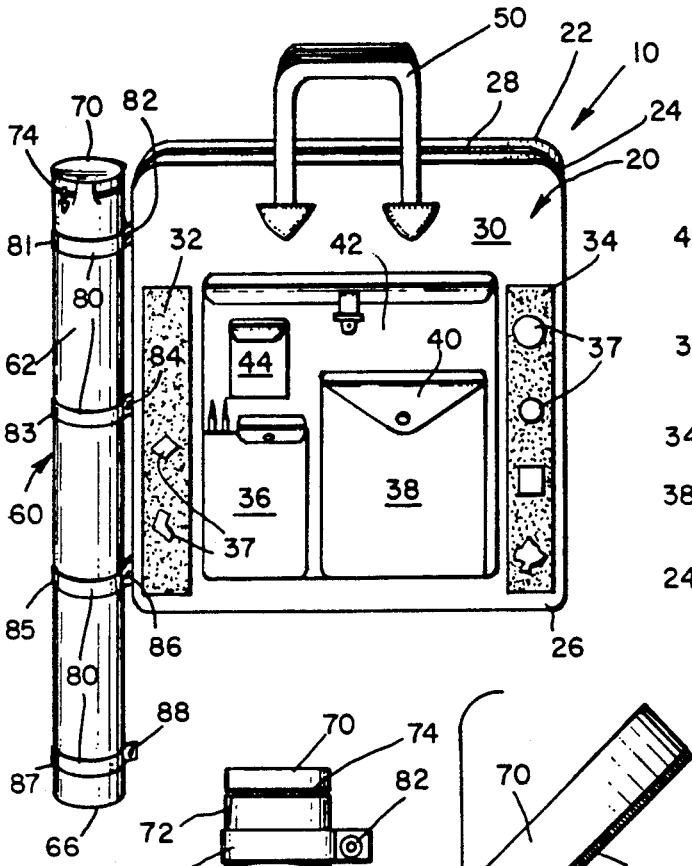
FIG. 1 is a front perspective view of the present invention specialized case and attachment for carrying rolled up objects.

Referring to FIG. 1, there is shown at 10 the entire specialized case and attachment for carrying rolled up objects. The case comprises two major components. A main case 20 is essentially a standard case which may be formed in two sections 22 and 24 which are flexibly attached to each other along a common bottom edge 26 and are locked together by closure means such as a zipper 28. The interior of the case 10 is usually a flap surface which may contain conventional pockets into which are inserted flat objects such as brochures, advertising flyers, and comparable flat printed or photographic matter. One section of the case such as 24 may comprise a multiplicity of pocket members on the outside surface 30 which are arranged in any desired order and which are configured in any desired shape to hold different types of objects. For example, in the illustration in FIG. 1, pocket member 36 is a conventional pencil and pen holder pocket. Pocket member 38 may be used to contain computer diskettes since it is essentially flat and can be closed by means of a top flap 40. Large pocket 42 can be used to carry notebooks, pads, charts and comparable objects. Little pocket 44 can be used to carry business cards. In addition, the case may include elongated strip members 32 and 34 which are made out of material such as felt and into which can be attached pins 37 and other decorative objects obtained at conventions. The entire case is held by handle 50. It will be appreciated that the main case 20 can be of any desired configuration with any desired arrangement of pockets both on the outside of the case as illustrated and also on the inside of the case.

Figure 3:
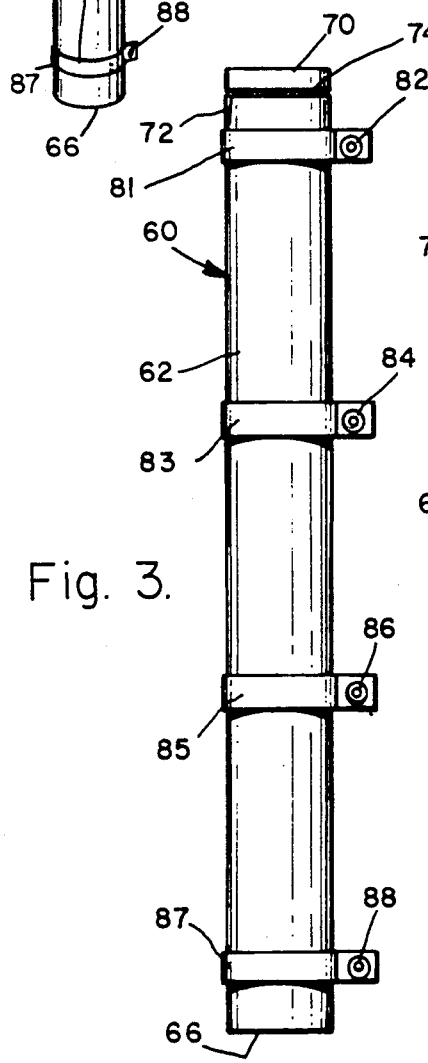
FIG. 3 is a side elevational view of the attachment section of the case used to carry rolled up objects.
Figure 4:
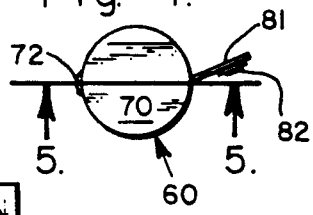
FIG. 4 is a top plan view of the attachment section of the case used to carry rolled up objects.
Figure 5:
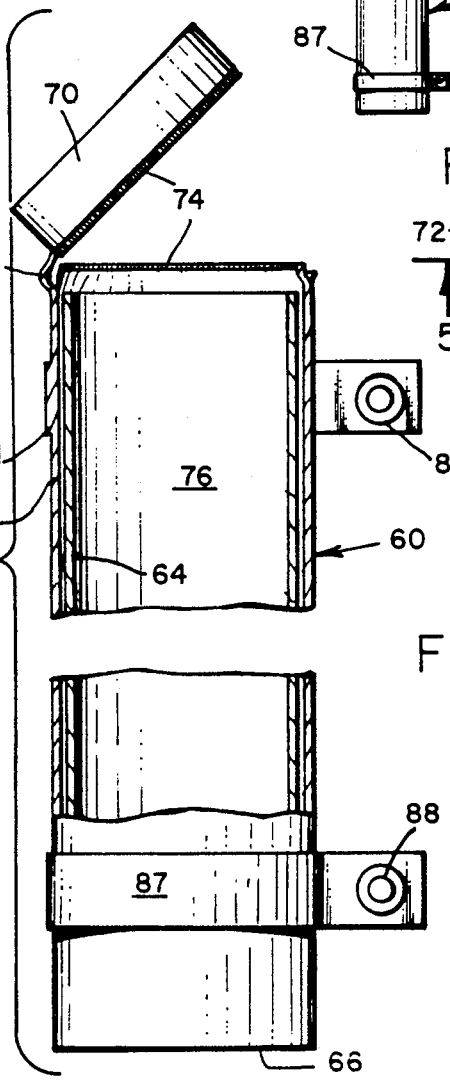
FIG. 5 is a side elevational view in partial crosssection taken along line 5—5 of FIG. 4.

The major feature of uniqueness of the present invention is the addition of the second component which is a removable cylindrical case which can be used to carrying objects in a rolled up configuration. Referring to FIGS. 3 through 5, the cylindrical case 60 comprises an outer wall 62 and an interior stiffening wall 64. The interior stiffening wall 64 goes around the entire interior surface of the cylindrical case 60 and the exterior wall 62 envelopes the outside of the interior stiffening wall 64. A flat bottom 66 closes the lower end of the cylindrical case 66. A top 70 is attached at one location by attaching means such as a strip of material 72 to a portion of the exterior wall 62. The top 70 can be affixed by closure means 74 which by way of example can be a zipper connecting the top 70 to the exterior wall 62. The interior wall 64 surrounds an interior chamber 76 into which objects can be placed and retained. The cylindrical configuration of the case 60 and therefore the cylindrical configuration of interior chamber 76 enables objects to be rolled up and carried in the case. By way of example, posters, works of art, blueprints, etc. may be rolled up and carried within the interior chamber 76 of case 60. Flexibly attached to the exterior wall 62 of case 60 are a multiplicity of attaching means which are preferably mating snap members. One way in which the attaching means are attached to the exterior wall 62 is by a strap attached to the exterior wall 62 and to which the attaching means is 80 is connected. Referring to FIGS. 3 and 5, straps 81, 83, 85 and 87 are spaced apart along the length of cylindrical case 60 and are attached to exterior wall 62. A male snap member 82, 84, 86 and 88 is attached to a respective one of the straps. In the way, the snap members are easily accessible.

Figure 2:
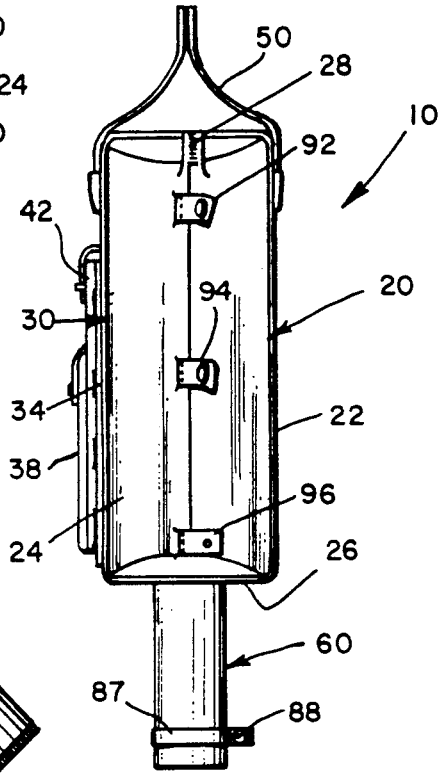
FIG. 2 is a side elevational view looking from the right side of the present invention specialized case and attachment for carrying rolled up objects.

Referring to FIG. 2, at least one side edge of main case 20 comprises a multiplicity of spaced apart mating attaching members which in this illustration are mating female snap members 92, 94 and 96. The female snap members are spaced apart by a distance equal to the spacing between the male snap members so that a respective one of the male snap members can be aligned with a respective one of the female snap members. In the embodiment illustrated, there are four male snap members on cylindrical case 60 and only three female snap members on the main case. Since the length of the cylindrical tube is usually larger than the height of the case, this snap member configuration is used to permit the user to align the larger cylindrical case 60 relative to the main case 20 such that the cylindrical case either hangs below the main case as illustrated in FIG. 1 or extends above it.

While the female mating snaps must be on at least one side of the main case 20, in the preferred embodiment they are on both sides of the case; on the left side as illustrated in FIG. 1 and on the right side as well, as illustrated in FIG. 2. In this way the user can select which side he wishes to have the cylindrical case placed. Additionally, with this configuration it is also possible to have two cylindrical cases supported on the main case on both side of the main case so that two cylindrical cases 60 are supported on the main case 20.

While the attaching means have been described as male snap members on the cylindrical case 60 and female snap members on the main case 20, it will be appreciated that it is within the spirit and scope of the present invention to have this reversed with female snap members on the cylindrical case and male snap members on the main case. Additionally, there can be both male and female snap members on both the cylindrical case and the main case so long as each male snap member is aligned with a corresponding female snap member. Other closure means such as mating Velcro-R members can also be used instead, but the snap members are preferred because they provide a tighter closure member to assure a locking closure to withstand the buffeting that the combined cases will take when being carried on an airplane, train, or other vehicle.

The interior stiffening wall 64 can be made of standard heavy cardboard or comparable material and the exterior wall 64 as well as the rest of the case can be made of any conventional case material such as plastic, nylon, vinyl or leather. The dimensions can be any size dimensions to accommodate different uses. By way of example, the length of the cylindrical case may be approximately 36 inches but this is just one of numerous optional lengths.

The present invention is therefore defined as a case for carrying objects, comprising: (a) a main case configured in a generally rectangular configuration having a pair of oppositely disposed transverse edges, and comprised of two sections which can be spread apart to expose the interior of the main case and closed together to envelop the interior of the main case and expose an exterior surface of each section; (b) a multiplicity of pockets attached to the exterior surface of at least one section of said main case; (c) a cylindrical case including a cylindrical interior stiffening wall having an interior and exterior surface, and an exterior wall enveloping the exterior surface of the interior stiffening wall, a cylindrical chamber defined by the interior surface of the interior stiffening wall; and (d) means for attaching the exterior wall of said cylindrical case to one transverse edge of said main case; (e) whereby objects of various configurations may be retained in the respective multiplicity of pockets of said main case and objects in a rolled up configuration may be retained in said cylindrical case.

Said means for attaching the exterior wall of said cylindrical case to one transverse edge of said main case comprises a multiplicity of snaps at spaced apart locations along the length of said cylindrical case and corresponding mating snaps spaced apart along the length of one transverse edge of said main case such that a respective one snap on the cylindrical case corresponds to a respective one snap on the main case.

Defined even more broadly, the present invention is a case for carrying objects, comprising: (a) a main case having at least one edge and including a multiplicity of pockets for carrying objects; (b) a cylindrical case including an exterior wall and an interior cylindrical chamber; and (c) means for attaching the exterior wall of said cylindrical case to the at least one edge of said main case; (d) whereby objects of various configurations may be retained in the respective multiplicity of pockets of said main case and objects in a rolled up configuration may be retained in said cylindrical case.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A specialized portable case for trade show visitors to carry large sheet objects in a rolled up condition as well as other assorted objects, comprising:

a. a first container of a generally slim, elongated cylindrical configuration having an openable end, and a circumferential side which has an exterior surface;

b. a second container of a generally rectangular configuration having a straight outer edge, an interior, and a multiplicity of exposed external pockets;

c. attaching means for attaching the exterior surface of the circumferential side of said first container to the straight outer edge of said second container;

d. whereby large flexible sheet objects may be retained in said first container in a rolled up condition, small variously configured objects may be retained in the respective multiplicity of exposed external pockets of said second container for direct access, and other valuable objects may be safely retained inside said second container.

2. The invention in accordance with claim 1 wherein said first container further comprises an internal stiffening layer which has an interior surface defining a cylindrical chamber.

3. The invention in accordance with claim 1 wherein said first container is made of semi-rigid thick nylon material.

4. The invention in accordance with claim 1 wherein said first container is about three inches in diameter and twenty-five inches in length.

5. The invention in accordance with claim 1 wherein said attaching means comprises a multiplicity of snap mating members at spaced apart locations along the length of the exterior surface of the circumferential side of said first container, a multiplicity of complementary snap mating members at spaced apart locations along the length of the straight outer edge of said second container, such that a respective one snap mating member on said first container corresponds to a respective one complementary snap mating member on said second container.

6. The invention in accordance with claim 1 wherein said attaching means comprises a multiplicity of hook mating members at spaced apart locations along the length of the exterior surface of the circumferential side of said first container, a multiplicity of loop mating members at spaced apart locations along the length of the straight outer edge of said second container, such that a respective one hook mating member on said first container corresponds to a respective one loop mating member on said second container.

7. A specialized portable case for trade show visitors to carry large sheet objects in a rolled up condition a well as other assorted objects, comprising:

a. a first container of a generally slim, elongated cylindrical configuration having an openable end, a circumferential side which has an exterior surface, and an internal stiffening layer which has an interior surface defining a cylindrical chamber;

b. a second container of a generally slim, elongated cylindrical configuration having an openable end, a circumferential side which has an exterior surface, and an internal stiffening layer which has an interior surface defining a cylindrical chamber;

c. a third container of a generally rectangular configuration having a first straight outer edge and an opposite second straight outer edge, an interior, and a multiplicity of exposed external pockets;

d. first attaching means having a multiplicity of snap mating members at spaced apart locations along the length of the exterior surface of the circumferential side of said first container, a multiplicity of complementary snap mating members at spaced apart locations along the length of the first straight outer edges of said third container, such that a respective one snap mating member on said first container corresponds to a respective one complementary snap mating member on said third container, for attaching the exterior surface of the circumferential side of said first container to the first straight outer edge of said third container; and e. second attaching means having a multiplicity of snap mating members at spaced apart locations along the length of the exterior surface of the circumferential side of said second container, a multiplicity of complementary snap mating members at spaced apart locations along the length of the second straight outer edge of said third container, such that a respective one snap mating member on said second container corresponds to a respective one complementary snap mating member on said third container, for attaching the exterior surface of the circumferential side of said second container to the second straight outer edge of said third container;

f. whereby large flexible sheet objects may be retained in the respective cylindrical chambers of said first and second containers in a rolled up conditions, small variously configured objects may e retained in the respective multiplicity of exposed external pockets of said third container for direct access, and other valuable objects may be safely retained inside said third container.

8. The invention in accordance with claim 7 wherein said first container is about three inches in diameter and twenty-five inches in length.

9. A specialized portable case for trade show visitors to carry large sheet objects in a rolled up condition as well as other assorted objects, comprising:

a. a first container of a generally slim, elongated cylindrical configuration having an openable end, a circumferential side which has an exterior surface, and a internal stiffening layer which as an interior surface defining a cylindrical chamber;

b. a second container of a generally slim, elongated cylindrical configuration having an openable end, an circumferential side which has an exterior surface, and an internal stiffening layer which has an interior surface defining a cylindrical chamber;

c. a third container of a generally rectangular configuration having a first straight outer edge and an opposite second straight outer edge, an interior and a multiplicity of exposed external pockets;

d. first attaching means having a multiplicity of hook mating members at spaced apart locations along the length of the exterior surface of the circumferential side of said first container, a multiplicity of loop mating members at spaced apart locations along the length of the first straight outer edge of said third container, such that a respective one hook mating member on said first container corresponds to a respective one loop mating member on said third container, for attaching the exterior surface of the circumferential side of said first container to the first straight outer edge of said third container; and e. second attaching means having a multiplicity of hook mating members at spaced apart locations along the length of the exterior surface of the circumferential side of said second container, a multiplicity of loop mating members at spaced apart locations along the length of the second straight outer edge of said third container, such that a respective one hook mating member on said second container corresponds to a respective one loop mating member on said third container, for attaching the exterior surface of the circumferential side of said second container to the second straight outer edge of said third container;

f. whereby large flexible sheet objects may be retained in the respective cylindrical chambers of said first and second containers in a rolled up condition, small variously configured objects may be retained in the respective multiplicity of exposed external pockets of said third container for direct access, and other valuable objects may be safely retained inside said third container.

10. The invention in accordance with claim 9 wherein said first container is about three inches in diameter and twenty-five inches in length.

11. A specialized portable case for trade show visitors to carry large sheet objects in a rolled up condition as well as other assorted objects, comprising:

a. at least one generally slim, elongated cylindrical container having at least one openable end, and a circumferential side which has an exterior surface;

b. a generally rectangular container having at least one straight outer edge, an interior and a multiplicity of exposed external pockets; and c. at least one attaching means for attaching the exterior surface of the circumferential side of said at least one generally slim, elongated cylindrical container to the at least one straight outer edge of said generally rectangular container;

d. whereby large flexible sheet objects may be retained in said at least one generally slim, elongated cylindrical container in a rolled up condition, small variously configured objects may be retained in the respective multiplicity of exposed external pockets of said generally rectangular container for direct access, and other valuable objects may be safely retained in side said generally rectangular container.

12. The invention in accordance with claim 11 wherein said at least one attaching means comprises a multiplicity of snap mating members at spaced apart locations along the length of the exterior surface of the circumferential side of said at least one generally cylindric container, a multiplicity of complementary snap mating members at spaced apart locations along the length of the at least one straight outer edge of said generally rectangular container, such that a respective one snap mating member on said at least one generally slim, elongated cylindrical container corresponds to a respective one complementary snap mating member on said generally rectangular container.

13. The invention in accordance with claim 11 wherein said at least one attaching means comprises a multiplicity of hook mating member at spaced part locations along the length of the exterior surface of the circumferential side of said at least one generally cylindric container, a multiplicity of loop mating members at spaced apart locations along the length of the at least one straight outer edge of said generally rectangular container, such that a respective one hook mating member on said at least one generally slim, elongated cylindrical container corresponds to a respective one loop mating member on said generally rectangular container.

* * * * *